US010720100B2

(12) United States Patent
Lee et al.

(10) Patent No.: US 10,720,100 B2
(45) Date of Patent: Jul. 21, 2020

(54) ORGANIC LIGHT EMITTING DISPLAY DEVICE AND METHOD FOR DRIVING THE SAME

(71) Applicant: LG Display Co., Ltd., Seoul (KR)

(72) Inventors: Jeisung Lee, Seoul (KR); Namseok Choi, Gimpo-si (KR); Joo-Young An, Goyang-si (KR); Jihoon Park, Paju-si (KR); Chulha Park, Seoul (KR)

(73) Assignee: LG Display Co., Ltd., Seoul (KR)

( * ) Notice: Subject to any disclaimer, the term of this patent is extended or adjusted under 35 U.S.C. 154(b) by 130 days.

(21) Appl. No.: 15/791,306

(22) Filed: Oct. 23, 2017

(65) Prior Publication Data

US 2018/0151119 A1 May 31, 2018

(30) Foreign Application Priority Data

Nov. 25, 2016 (KR) ..... 10-2016-0158008

(51) Int. Cl.
*G09G 3/3233* (2016.01)
*G09G 3/3291* (2016.01)
(Continued)

(52) U.S. Cl.
CPC ..... *G09G 3/3233* (2013.01); *G09G 3/3258* (2013.01); *G09G 3/3275* (2013.01);
(Continued)

(58) Field of Classification Search
CPC ..... G09G 2300/043; G09G 2300/0819; G09G 2300/0861; G09G 2310/0272;
(Continued)

(56) References Cited

U.S. PATENT DOCUMENTS 7,199,771 B2 4/2007 Yamazaki et al.
7,619,596 B2 11/2009 Tada
(Continued)

FOREIGN PATENT DOCUMENTS

CN 1409403 A 4/2003
CN 1595486 A 3/2005
(Continued)

OTHER PUBLICATIONS

United Kingdom Intellectual Property Office, Combined Search and Examination Report under Sections 17 & 18(3), GB Patent Application No. GB1718816.0, dated Mar. 27, 2018, six pages.
(Continued)

*Primary Examiner* — Ram A Mistry
(74) *Attorney, Agent, or Firm* — Fenwick & West LLP

(57) ABSTRACT

An organic light emitting display (OLED) device may include a display panel, a gate driver, a data driver, a timing controller and a deterioration compensation unit. The deterioration compensator may detect one or more deteriorated regions in the display region based on stress data of the respective pixels, the stress data being generated by counting input data corresponding to the respective pixels, and generate compensation data of pixels included in each of the deteriorated regions, based on the stress data of the respective pixels and sensing data for deteriorations of pixels included in two or more horizontal lines which are arbitrarily selected among horizontal lines corresponding to the deteriorated region.

13 Claims, 9 Drawing Sheets

(51) Int. Cl.
*G09G 3/3258* (2016.01)
*G09G 3/3275* (2016.01)

(52) U.S. Cl.
CPC ..... *G09G 3/3291* (2013.01); *G09G 2300/043* (2013.01); *G09G 2300/0819* (2013.01); *G09G 2300/0861* (2013.01); *G09G 2310/0272* (2013.01); *G09G 2310/067* (2013.01); *G09G 2320/0295* (2013.01); *G09G 2320/043* (2013.01); *G09G 2320/0693* (2013.01)

(58) Field of Classification Search
CPC ..... G09G 2310/067; G09G 2320/0295; G09G 2320/043; G09G 2320/0693; G09G 3/3233; G09G 3/3258; G09G 3/3275; G09G 3/3291
See application file for complete search history.

(56) References Cited

U.S. PATENT DOCUMENTS

| | | | | |
|---|---|---|---|---|
| 7,675,492 | B2 | 3/2010 | Park et al. | |
| 7,688,291 | B2 | 3/2010 | Yamazaki et al. | |
| 8,026,876 | B2 | 9/2011 | Nathan et al. | |
| 8,497,857 | B2 | 7/2013 | Nakamura | |
| 8,581,809 | B2 * | 11/2013 | Nathan | G09G 3/3233 345/78 |
| 9,349,317 | B2 | 5/2016 | Kim et al. | |
| 9,767,734 | B2 | 9/2017 | Jun et al. | |
| 10,013,904 | B2 | 7/2018 | Park | |
| 10,217,418 | B2 | 2/2019 | Kim et al. | |
| 2003/0063053 | A1 * | 4/2003 | Yamazaki | G09G 3/3241 345/82 |
| 2005/0052369 | A1 | 3/2005 | Tada | |
| 2006/0279490 | A1 | 12/2006 | Park et al. | |
| 2007/0097038 | A1 | 5/2007 | Yamazaki et al. | |
| 2011/0069061 | A1 | 3/2011 | Nakamura | |
| 2013/0249965 | A1 | 9/2013 | Nakamura | |
| 2014/0176401 | A1 | 6/2014 | Kim et al. | |
| 2014/0176409 | A1 | 6/2014 | Kim et al. | |
| 2016/0098952 | A1 | 4/2016 | Han et al. | |
| 2016/0133175 | A1 | 5/2016 | Lee | |
| 2016/0171934 | A1 | 6/2016 | Yang et al. | |
| 2016/0189634 | A1 | 6/2016 | Kim et al. | |
| 2016/0210903 | A1 | 7/2016 | Jun et al. | |
| 2016/0322020 | A1 | 11/2016 | Park | |

FOREIGN PATENT DOCUMENTS

| | | | |
|---|---|---|---|
| CN | 1877677 | A | 12/2006 |
| CN | 102024420 | A | 4/2011 |
| CN | 103903560 | A | 7/2014 |
| CN | 103973631 | A | 8/2014 |
| CN | 105225621 | A | 1/2016 |
| CN | 105741773 | A | 7/2016 |
| CN | 105810148 | A | 7/2016 |
| CN | 106097948 | A | 11/2016 |
| JP | 2008-165159 | A | 7/2008 |
| JP | 2010-237528 | A | 10/2010 |
| KR | 10-2014-0082498 | A1 | 7/2014 |
| KR | 10-2016-0055058 | A1 | 5/2016 |

OTHER PUBLICATIONS

Japan Patent Office, Notification of Reasons for Refusal, JP Patent Application No. 2017-216941, dated Oct. 29, 2018, seven pages.
China National Intellectual Property Administration, First Notification of Office Action, CN Patent Application No. 201711204007.5, dated Apr. 14, 2020, 21 pages.

* cited by examiner

ORGANIC LIGHT EMITTING DISPLAY DEVICE AND METHOD FOR DRIVING THE SAME

CROSS-REFERENCE TO RELATED APPLICATIONS

This application claims the benefit of Republic of Korea Patent Application No. 10-2016-0158008, filed on Nov. 25, 2016, which is hereby incorporated by reference in its entirety.

BACKGROUND

Field of Technology

The present disclosure relates to an organic light emitting display (OLED) device and a method for driving the same, and more particularly, to an OLED device capable of compensating for a difference in deterioration between pixels, and a method for driving the same.

Discussion of the Related Art

A flat display device is applied to various electronic devices such as televisions, mobile phones, notebook computers and tablet computers. For this application, research has been continuously conducted on a technique for reducing the thickness, weight and power consumption of the flat display device.

Representative examples of the flat display device may include a liquid crystal display (LCD) device, a plasma display panel (PDP) device, a field emission display (FED) device, an electro luminescence display (ELD) device, an electro-wetting display (EWD) device and an organic light emitting display (OLED) device.

Among the representative examples, the OLED device displays an image using an OLED corresponding to each pixel.

FIG. 1 is an equivalent circuit diagram corresponding to each pixel of a general OLED device.

As illustrated in FIG. 1, the pixel of the OLED device includes a first switching thin film transistor (TFT) ST1, a second switching TFTST2, a driving TFT DT, a storage capacitor Cst and an OLED.

The first switching TFT ST1 is turned on in response to a scan signal scan of a gate line GL. At this time, the first switching TFT ST1 supplies a data signal Vdata of a data line DL to the driving TFT DT and the storage capacitor Cst.

The driving TFT DT is turned on in response to the data signal Vdata supplied through the first switching TFT ST1. At this time, a driving current I_oled between first and second driving voltages VDD and VSS is supplied to the OLED through the driving TFT DT. The driving TFT DT maintains a turn-on state based on a voltage stored in the storage capacitor Cst.

The OLED emits light based on the driving current I_oled. At this time, the magnitude of the driving current I_oled may be controlled through switching of the driving TFT DT.

The OLED and the driving TFT DT may be deteriorated depending on usage. Furthermore, the uniformity and reliability in brightness of the pixel and the image quality of the pixel may be degraded by the deteriorated OLED or driving TFT DT.

In particular, a specific region for displaying a logo or advertisement in the display region is used at a higher frequency than in the surrounding other regions. Thus, since the deterioration of the specific region becomes different from those of the surrounding other regions, a defect such as afterimage may occur.

In order to prevent such a defect, the driving currents I_oled supplied to the OLEDs of the whole pixels may be sequentially sensed, and a difference in characteristic between the respective pixels may be compensated for based on the sensing result. In this case, a period for sensing the whole pixels must be added to a point of time that the operation of the device is started or ended, and a pixel of which the driving current I_oled is sensed may be visually recognized.

In order to solve such a problem, a data counting method has been suggested.

The data counting method performs deterioration modeling based on stress data accumulated through counting of input data corresponding to each pixel, instead of sensing the driving current I_oled. According to the result of the deterioration modeling, the data counting method compensates for a characteristic variation of each pixel. However, while the actual deterioration of the OLED or the driving TFT DT is sensitive to an external factor such as light or temperature, the data counting method has a difficulty in reflecting the external factor.

FIG. 2 is a diagram for describing the problem of the deterioration compensation method using the data counting method.

As illustrated in FIG. 2, an error between the actual deterioration of the pixel and the deterioration of the pixel which is estimated through the data counting method may increase, because the data counting method cannot reflect external factors. In particular, the error in the deterioration of the pixel, which is estimated through the data counting method, may be gradually accumulated. In this case, a defect such as overcompensation or non-compensation may occur while the difference in characteristic between the pixels is excessively or insufficiently compensated for.

SUMMARY

Various embodiments are directed ton OLED device which is capable of preventing an accumulation of error in deterioration of a pixel by a data counting method, thereby improving the accuracy of compensation for a characteristic difference between pixels, and a method for driving the same.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In an embodiment, an OLED device may include a display panel, a gate driver, a data driver, a timing controller and a deterioration compensation unit. The deterioration compensator may detect one or more deteriorated regions in the display region based on stress data of the respective pixels, the stress data being generated by counting input data corresponding to the respective pixels, and generate compensation data of pixels included in each of the deteriorated regions, based on the stress data of the respective pixels and sensing data for deteriorations of pixels included in two or more horizontal lines which are arbitrarily selected among horizontal lines corresponding to the deteriorated region.

The deterioration compensator may include: a data counting unit configured to generate accumulated data of the respective pixels by counting the input data corresponding to the respective pixels; a deterioration prediction unit configured to generate the stress data of the respective pixels by predicting the deteriorations of the respective pixels according to the accumulated data of the respective pixels; a deteriorated region detection unit configured to detect one or more deteriorated regions in the display region, based on the stress data of the respective pixels; a sensing control unit configured to receive the sensing data for the deteriorations of the pixels included in the two or more horizontal lines which are arbitrarily selected in each of the deteriorated regions; and a first compensation data generation unit configured to generate the compensation data of the pixels included in each of the deteriorated regions, based on the sensing data and the stress data of the respective pixels.

When a difference between the sensing data and the original stress data of a pixel corresponding to the sensing data is greater than or equal to a threshold difference, the first compensation data generation unit may correct the original stress data based on the sensing data and a predetermined sensing data weight. The first compensation data generation unit may calculate a correction ratio based on the original stress data and the corrected stress data, correct stress data of the pixels included in each of the deteriorated regions based on the correction ratio, and generate the compensation data of the pixels included in each of the deteriorated regions based on the corrected stress data of the pixels included in the deteriorated region.

Since the deteriorations of the pixels by the data counting method can be corrected according to the actual deteriorations of the pixels by the sensing method by the deterioration compensator, the reliability and accuracy of the compensation data can be improved, and non-compensation and overcompensation can be prevented. Furthermore, only the actual deteriorations of partial pixels can be sensed to prevent the sensing mode from being recognized.

In another embodiment, a method for driving an OLED device may include: generating accumulated data of the respective pixels by counting input data corresponding to the respective pixels; generating stress data of the respective pixels by predicting deteriorations of the respective pixels according to the accumulated data of the respective pixels; detecting one or more deteriorated regions in the display region, based on the stress data of the respective pixels; receiving sensing data for deteriorations of pixels included in two or more horizontal lines which are arbitrarily selected in each of the deteriorated regions; and generating compensation data of pixels included in each of the deteriorated regions, based on the sensing data and the stress data of the respective pixels.

The generating of the compensation data of the pixels included in each of the deteriorated regions may include: correcting the original stress data of a pixel corresponding to the sensing data, based on the sensing data and a predetermined sensing data weight, when a difference between the sensing data and the original stress data is greater than or equal to a threshold difference; calculating a correction ratio based on the original stress data and the corrected stress data; correcting stress data of the pixels included in each of the deteriorated regions, based on the correction ratio; and generating the compensation data of the pixels included in each of the deteriorated regions, based on the corrected stress data of the pixels included in each of the deteriorated regions.

DETAILED DESCRIPTION

Hereafter, an OLED device and a method for driving the same according to exemplary embodiments of the present disclosure will be described below in more detail with reference to the accompanying drawings.

Figure 3:
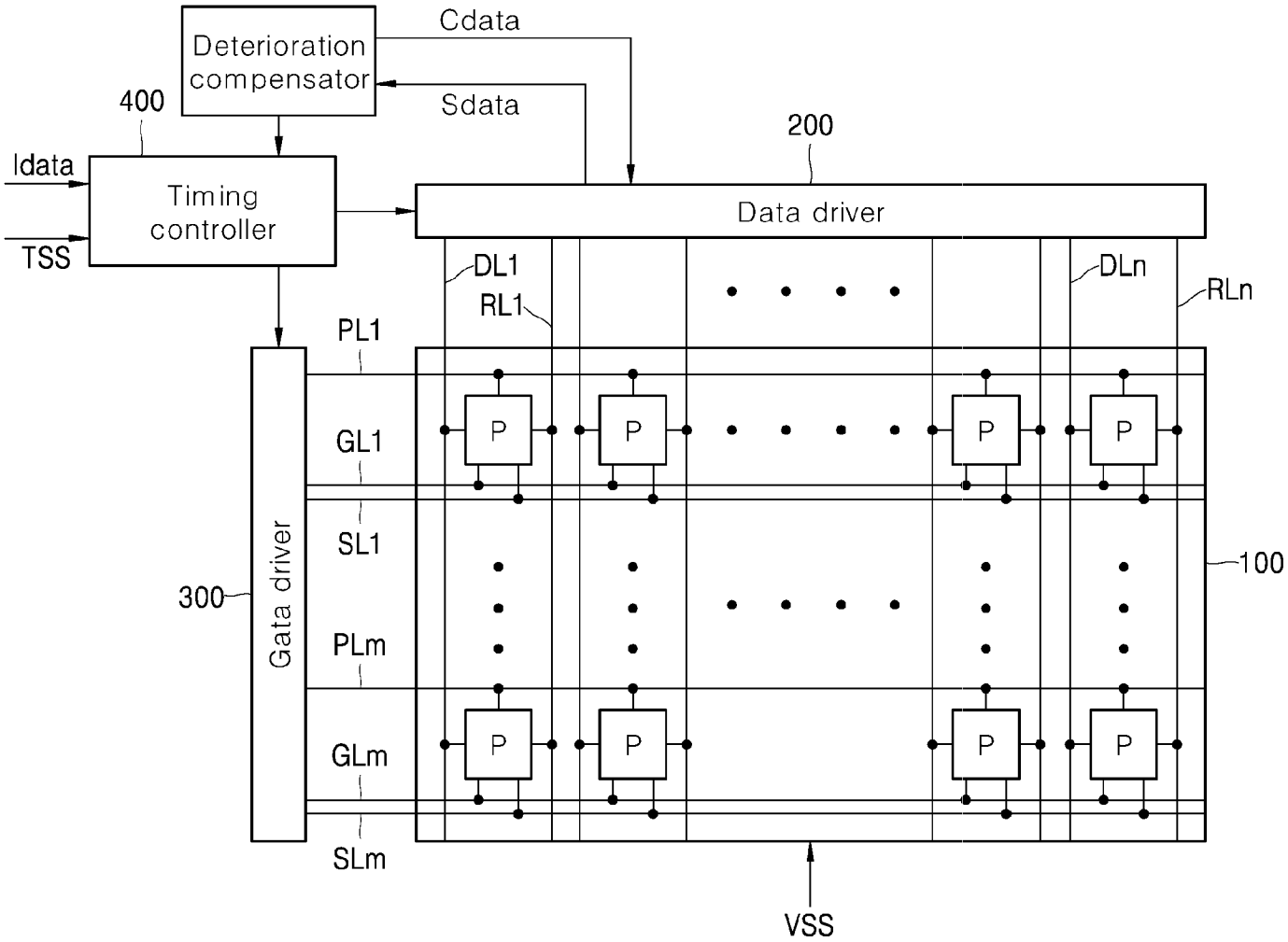
FIG. 3 schematically illustrates an OLED device according to an embodiment of the present disclosure.
Figure 4:
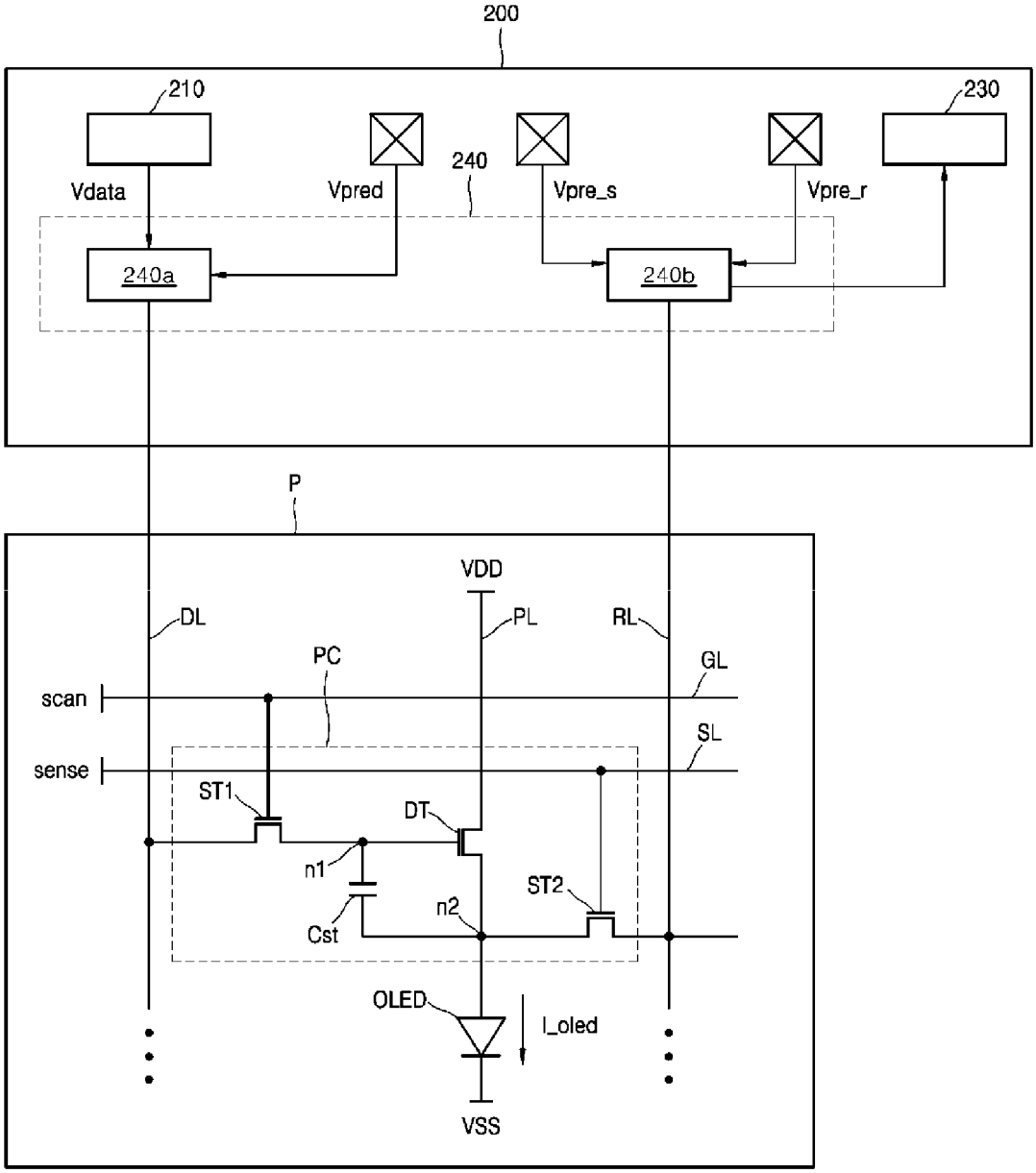
FIG. 4 is an equivalent circuit diagram corresponding to each pixel of FIG. 3 according to an embodiment of the present disclosure.
Figure 5:
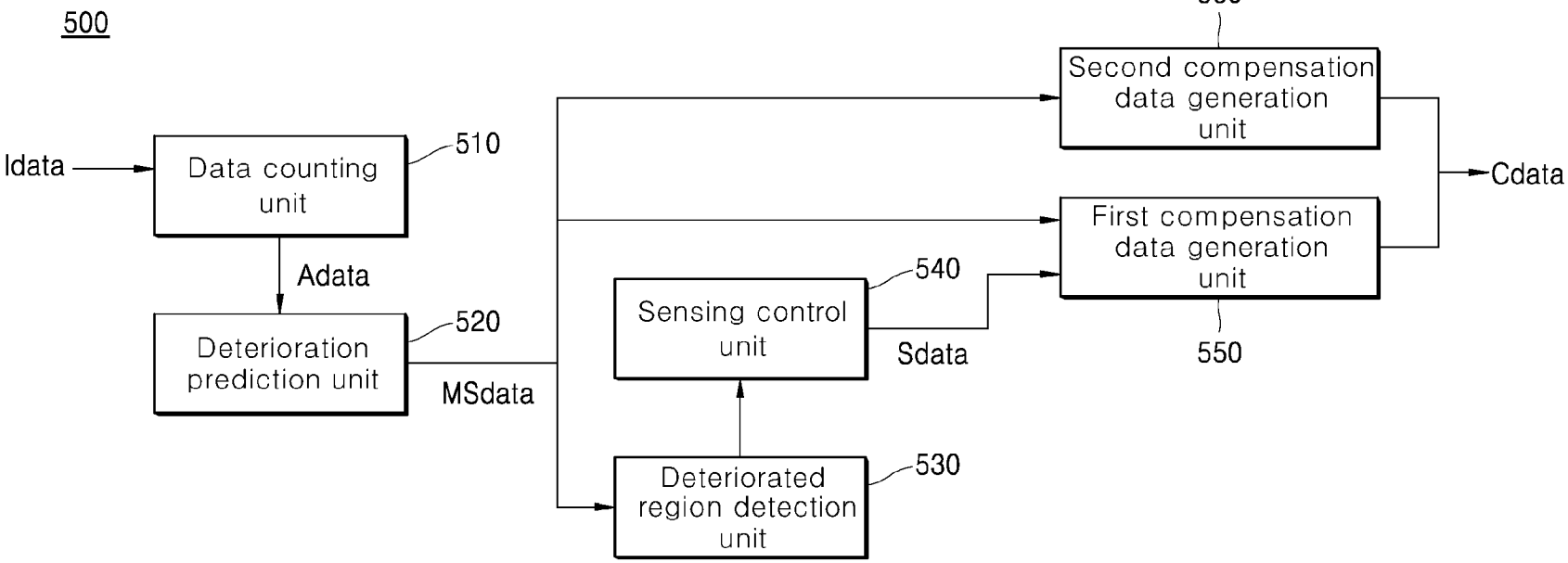
FIG. 5 illustrates a deterioration compensator of FIG. 3 according to an embodiment of the present disclosure.

Referring to FIGS. 3 to 5, an OLED device according to an embodiment of the present disclosure will be described.

FIG. 3 schematically illustrates the OLED device according to the embodiment of the present disclosure. FIG. 4 is an equivalent circuit diagram corresponding to each pixel of FIG. 3, and FIG. 5 illustrates a deterioration compensator of FIG. 3.

As illustrated in FIG. 3, the OLED device according to the embodiment of the present disclosure includes a display panel 100, a data driver 200, a gate driver 300, a timing controller 400 and a deterioration compensator 500.

The display panel 100 includes a display region corresponding to a plurality of pixels P.

The plurality of pixels P are arranged in a matrix shape on the display region. The plurality of pixels P are connected to gate lines GL1 to GLm, data lines DL1 to DLn, driving power lines PL1 to PLm, sensing signal lines SL1 to SLm and reference voltage lines RL1 to RLn, respectively, which are arranged outside the plurality of pixels P. Each of the pixels P includes an OLED and a pixel circuit for driving the OLED.

The gate lines GL1 to GLm and the data lines DL1 to DLn are arranged in directions crossing each other, and define a plurality of pixel regions corresponding to the respective pixels P. Furthermore, the gate lines GL1 to GLm, the driving power lines PL1 to PLm and the sensing signal lines SL1 to SLm may be arranged in a first direction (side-to-side direction of FIG. 3). The data lines DL1 to DLn and the reference voltage lines RL1 to RLn may be arranged in a second direction (top-to-bottom direction of FIG. 3) crossing the first direction.

The gate driver 300 supplies a scan signal to the plurality of pixels P through the gate lines GL1 to GLm. The gate driver 300 supplies a sensing signal to the plurality of pixels P through the sensing signal lines SL1 to SLm.

That is, when the display panel 100 is driven in a driving mode for displaying an image, the gate driver 300 may sequentially supply scan signals to the gate lines GL1 to GLm during vertical periods for displaying the respective image frames. In the driving mode, the gate driver 300 may supply a first driving voltage VDD to the plurality of pixels P through the driving power lines PL1 to PLm.

Furthermore, during a sensing period in which the display panel 100 is driven in a sensing mode for sensing the deterioration of a pixel, the gate driver 300 may sequentially supply scan signals to all or part of the sensing signal lines SL1 to SLm.

The data driver 200 supplies data signals to the plurality of pixels P through the data lines DL1 to DLn. The data driver 200 senses the deteriorations of the pixels P through the reference voltage lines RL1 to RLn.

That is, in the driving mode, the data driver 200 may supply a data signal to the data line DL during a horizontal period in which the scan signals are supplied to the gate lines GL in each of the vertical periods.

Furthermore, whenever the sensing signals are supplied to the respective sensing signal lines SL during the sensing period in which the display panel 100 is driven in the sensing mode for sensing the deteriorations of the pixels, the data driver 200 senses the voltage levels of the reference voltage lines RL1 to RLn.

The timing controller 400 may drive the gate driver 300 and the data driver 200 in any one of the driving mode and the sensing mode.

The timing controller 400 may drive the gate driver 300 and the data driver 200 in the driving mode, based on a timing synchronization signal TSS. At this time, an image corresponding to the input data Idata is displayed on the display panel 100.

That is, when the display panel 100 is driven in the driving mode, the timing controller 400 controls the gate driver 300 and the data driver 200 based on the input data Idata and the timing synchronization signal TSS. Thus, while the plurality of pixels P of the display panel 100 exhibit brightnesses depending on the respective input data Idata, the image may be displayed.

The timing controller 400 may drive the gate driver 300 and the data driver 200 in the sensing mode. For example, at one or more of a driving start point and a driving end point of the display panel 100 and a preset blank period during driving, the timing controller 400 may drive the gate driver 300 and the data driver 200 in the sensing mode.

The deterioration compensator 500 supplies compensation data for compensating the deteriorations of the respective pixels P to the data driver 200.

The deterioration compensator 500 detects one or more deteriorated regions in the display region, based on stress data of the pixels P, which are generated through counting of the input data Idata corresponding to the respective pixels P. The deterioration compensator 500 arbitrarily selects two or more horizontal lines among horizontal lines corresponding to each of the deteriorated regions. Then, the deterioration compensator 500 generates compensation data Cdata for pixels included in each of the deteriorated regions, based on the stress data and the sensing data for the deteriorations of pixels included in the selected horizontal lines.

The data signals Vdata supplied to the plurality of pixels P from the data driver 200 are compensated for based on the compensation data Cdata generated by the deterioration compensator 500.

As illustrated in FIG. 4, each of the pixels P includes an OLED and a pixel circuit PC for driving the OLED.

The pixel circuit PC includes a first switching TFT ST1, a second switching TFT ST2, a driving TFT DT and a storage capacitor Cst.

The first switching TFT ST1 is connected among the gate line GL, the data line DL and a first node n1. The first node n1 is located between the first switching TFT ST1 and the driving TFT DT. The first switching TFT ST1 is turned on in response to a scan signal scan of the gate line GL, and transmits the data signal Vdata of the data line DL to the first node n1.

The driving TFT DT is connected to the first node n1, the driving power line PL and a second node n2. The second node n2 is located between the driving TFT DT and the OLED.

The storage capacitor Cst is connected between the gate electrode and the drain electrode of the driving TFT DT. That is, the storage capacitor Cst is connected between the first node n1 and the second node n2. The storage capacitor Cst is charged with a difference voltage between the first and second nodes n1 and n2.

The OLED is connected between the second node n2 and a second driving voltage VSS.

Thus, the driving TFT DT is turned on, based on the voltage stored in the storage capacitor Cst and the data signal Vdata of the data line DL, which is supplied to the first node n1. Through the turned-on driving TFT DT, a current path is formed between the first and second driving voltages VDD and VSS, and a driving current is supplied to the OLED. At this time, the OLED emits light based on the driving current.

The second switching TFT ST2 is connected to the sensing signal line SL, the reference voltage line RL and the second node n2. The second switching TFT ST2 is turned on in response to a sensing signal sense of the sensing signal line SL, and transmits the voltage level of the second node n2 to the reference voltage line RL. That is, the driving current of the OLED is transmitted to the reference voltage line RL through the turned-on second switching TFT ST2. Thus, the driving current of the OLED may be sensed.

As described above, the data driver 200 may be driven in any one of the driving mode and the sensing mode, according to control of the timing controller 400 of FIG. 3.

The data driver 200 includes a data signal generation unit 210, a sensing data generation unit 230 and a switching unit 240.

The data signal generation unit 210 generates a data signal at a voltage level corresponding to the input data Idata. For example, the data signal generation unit 210 may include a shift register for generating a sampling signal, a latch for latching the input data Idata according to the sampling signal, a gray voltage generator for generating a plurality of gray voltages using a plurality of reference gamma voltages, a digital-to-analog converter for selecting a gray voltage corresponding to the latched input data Idata among the plurality of gray voltages and outputting the selected gray voltage as the data signal Vdata, and an output unit for outputting the data signal Vdata.

The switching unit 240 includes first and second switches 240*a* and 240*b*.

The first switch 240*a* transmits the data signal Vdata to the data line Dl in the driving mode, and transmits a first reference voltage Vpred to the data line DL in the sensing mode.

The second switch 240*b* transmits a second reference voltage Vpre_r to the reference voltage line RL in the driving mode, and transmits a sensing precharging voltage Vpre_s to the reference voltage line RL during a reset period in the sensing mode.

Then, during a sensing voltage charging period in the sensing mode, the second switching TFT ST2 of the pixel P is turned on to transmit the voltage level of the second node n2 to the reference voltage line RL. During a sensing period in the sensing mode, the voltage level of the reference voltage line RL is sensed by the sensing data generation unit 230.

As illustrated in FIG. 5, the deterioration compensator 500 according to the present embodiment includes a data counting unit 510, a deterioration prediction unit 520, a deteriorated region detection unit 530, a sensing control unit 540 and first and second compensation data generation units 550 and 560.

The data counting unit 510 generates accumulated data Adata of each pixel by counting the input data Idata corresponding to the pixel.

The deterioration prediction unit 520 generates stress data MSdata of each pixel, corresponding to a predictive value of the deterioration of the pixel, based on the accumulated data Adata of the pixel.

The deteriorated region detection unit 530 detects one or more deteriorated regions in the display region, based on the stress data MSdata of each pixel. The deteriorated region indicates a region which is deteriorated by a threshold difference or more, compared to the surrounding other regions.

For example, the deteriorated region detection unit 530 detects the maximum stress data of the plurality of horizontal lines, based on the stress data MSdata of each pixel. That is, the deteriorated region detection unit 530 detects the maximum stress data among the stress data of the pixels included in each of the horizontal lines. Each of the horizontal lines includes the pixels arranged in parallel to the first direction (side-to-side direction of FIG. 3) corresponding to the gate line GL.

The deteriorated region detection unit 530 calculates deterioration threshold data based on the maximum stress data of the respective horizontal lines. For example, the deterioration threshold data may be set to an average value of the maximum stress data of the plurality of horizontal lines. However, this is only an example, and the deterioration threshold data may be designated by a value that is arbitrarily preset by a designer.

The deteriorated region detection unit 530 detects deteriorated horizontal lines having the maximum stress data greater than or equal to the deterioration threshold data, among the plurality of horizontal lines. Then, the deteriorated region detection unit 530 selects one or more deteriorated regions including the deteriorated horizontal lines in the display region.

For example, the deteriorated region detection unit 530 may divide the display region into a plurality of block regions, and select a block region as a deteriorated region, the block region including a threshold number of deteriorated horizontal lines or more among the plurality of block regions. Alternatively, the deteriorated region detection unit 530 may select a region as a deteriorated region, the region having two or more deteriorated horizontal lines within a threshold interval.

The sensing control unit 540 arbitrarily selects two or horizontal lines among the horizontal lines included in each of the deteriorated regions, and receives sensing data for deteriorations of pixels included in the two or more horizontal lines selected in the deteriorated region. That is, the sensing control unit 540 controls the sensing data generation unit 230 of the data driver 200 of FIG. 4, and generates the sensing data for the deteriorations of the pixels included in the two or more horizontal lines selected in each of the deteriorated regions.

The first compensation data generation unit 550 generates compensation data of the pixels included in each of the deteriorated regions, based on the stress data of the pixels included in the deteriorated region and the sensing data received from the sensing control unit 540.

That is, when a difference between the sensing data and stress data of anyone pixel corresponding to the sensing data is greater than or equal to a threshold value, the first compensation data generation unit 550 corrects the stress data of the any one pixel, based on the sensing data and a predetermined sensing data weight. At this time, the corrected stress data may correspond to a weighted average between the sensing data and the original stress data. The sensing data weight may be calculated, based on the accumulated driving time of the device.

The first compensation data generation unit 550 generates compensation data Cdata for the any one pixel, based on the corrected stress data.

Furthermore, the first compensation data generation unit 550 calculates a correction ratio based on the original stress data of the any one pixel and the corrected stress data. The first compensation data generation unit 550 corrects the stress data of the other pixels included in the deteriorated region, based on the calculated correction ratio.

Then, the first compensation data generation unit 550 generates compensation data Cdata for the pixels included in the deteriorated region, based on the corrected stress data.

The second compensation data generation unit 560 generates compensation data for pixels included in the other regions excluding the deteriorated region in the display region, based on the stress data of the respective pixels. That is, the second compensation data generation unit 560 generates the compensation data Cdata for the pixels arranged in the other regions excluding the deteriorated region, based on the original stress data which are not corrected.

Next, referring to FIGS. 6 to 11, a method for driving an OLED device according to an embodiment of the present disclosure will be described.

Figure 6:
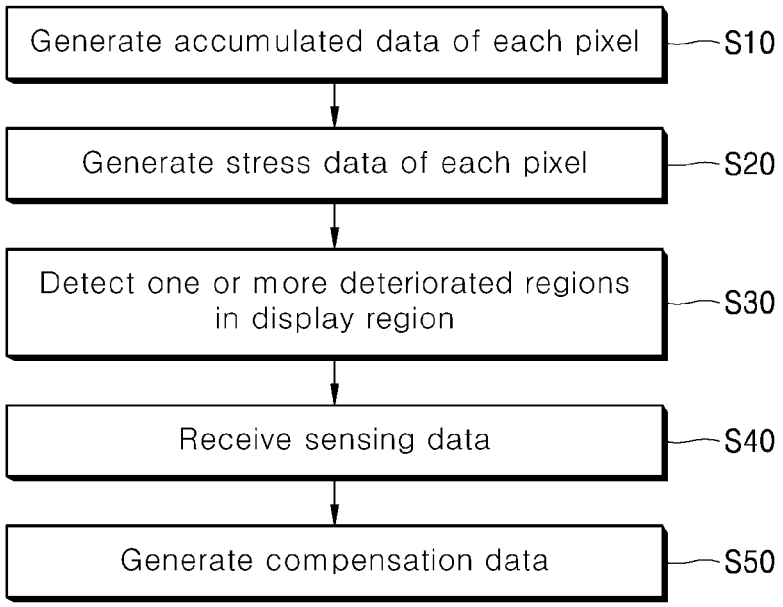
FIG. 6 is flowchart illustrating a method for driving an OLED device according to an embodiment of the present disclosure.
Figure 7:
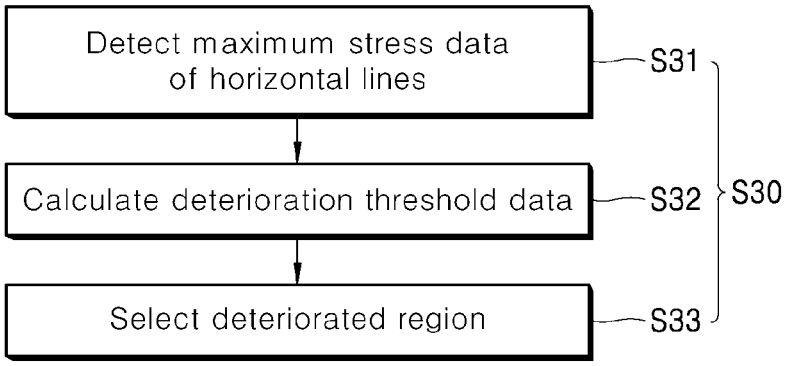
FIG. 7 is a flowchart illustrating a step of detecting one or more deteriorated regions in FIG. 6 according to an embodiment of the present disclosure.
Figure 8:
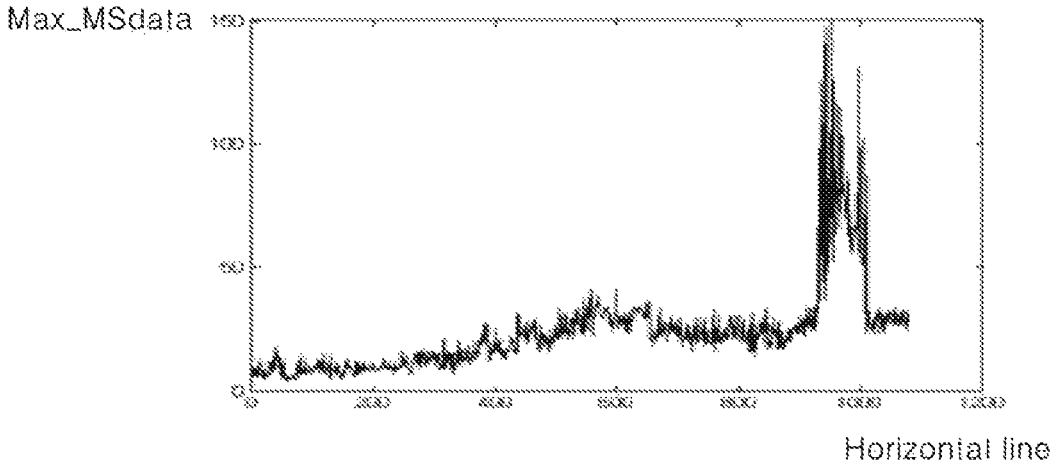
FIG. 8 illustrates the maximum stress data of a plurality of horizontal lines according to an embodiment of the present disclosure.
Figure 9:
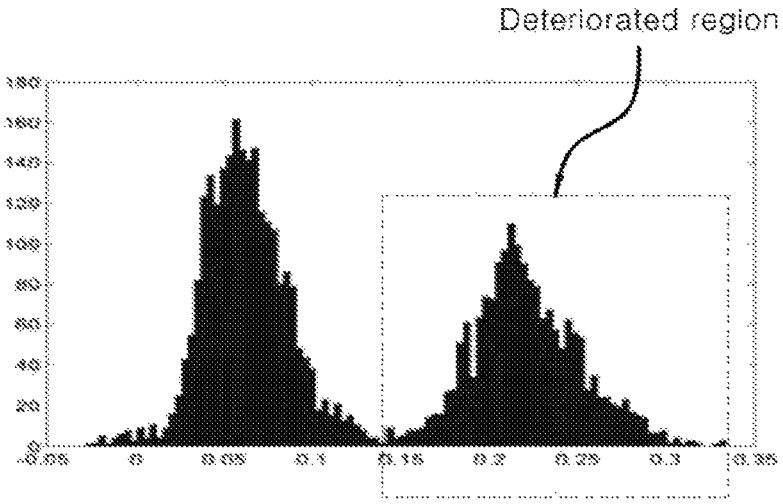
FIG. 9 is a histogram illustrating the maximum stress data of FIG. 8 according to an embodiment of the present disclosure.
Figure 10:
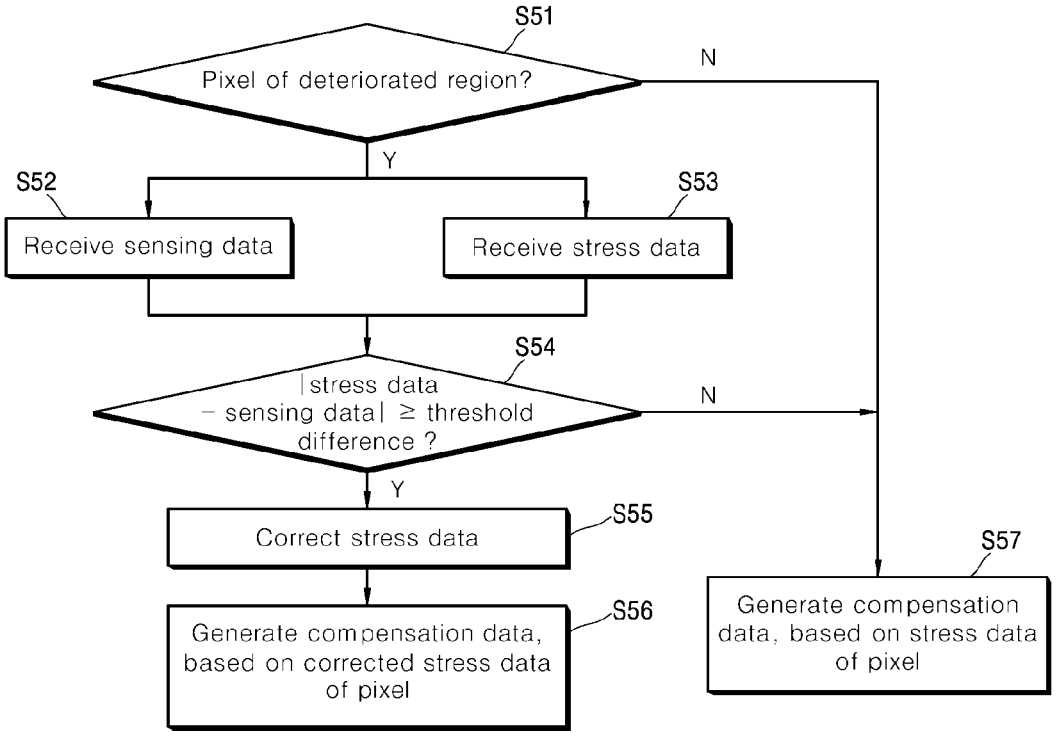
FIG. 10 is a flowchart illustrating a step of generating compensation data in FIG. 6 according to an embodiment of the present disclosure.
Figure 11:
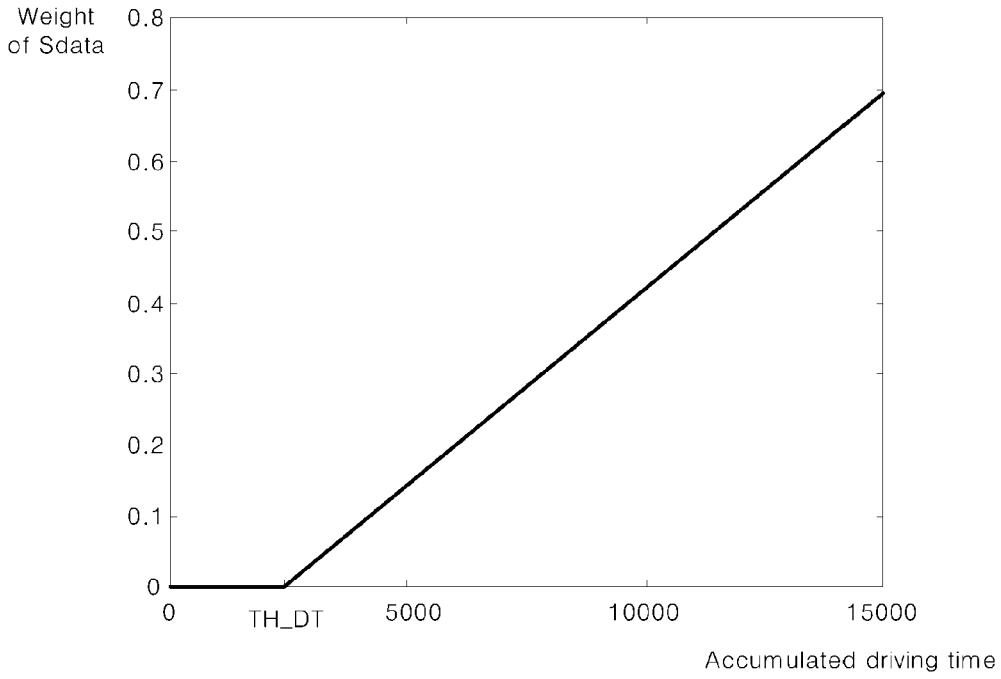
FIG. 11 illustrates an example of a sensing data weight at a step of correcting stress data in FIG. 10 according to an embodiment of the present disclosure.

FIG. 6 is flowchart illustrating the method for driving an OLED device according to the embodiment of the present disclosure. FIG. 7 is a flowchart illustrating a step of detecting one or more deteriorated regions in FIG. 6. FIG. 8 illustrates the maximum stress data of a plurality of horizontal lines, and FIG. 9 is a histogram illustrating the maximum stress data of FIG. 8. FIG. 10 is a flowchart illustrating a step of generating compensation data in FIG. 6. FIG. 11 illustrates an example of a sensing data weight at a step of correcting stress data in FIG. 10.

As illustrated in FIG. 6, the method for driving an OLED device according to the present embodiment includes a deterioration compensation process.

The method for driving an OLED device according to the present embodiment includes: generating accumulated data of each pixel by counting input data corresponding to the pixel at step S10; generating stress data of each pixel based on the accumulated data of the pixel, the stress data corresponding to a predictive value of the deterioration of the pixel, at step S20; detecting one or more deteriorated regions in a display region, based on the stress data of each pixel, at step S30; receiving sensing data for the deteriorations of pixels included in two or more horizontal lines which are arbitrarily selected among horizontal lines included in each of the deteriorated regions at step S40; and generating compensation data of each pixel based on the sensing data and the stress data of the pixel at step S50.

As illustrated in FIG. 7, the detecting of one or more deteriorated regions at step S30 includes: detecting the maximum stress data of a plurality of horizontal lines based on the stress data of each pixel at step S31; calculating deterioration threshold data based on the maximum stress data of the respective horizontal lines at step S32; and detecting a deteriorated horizontal line having the maximum stress data greater than or equal to the deterioration threshold data among the plurality of horizontal lines, and selecting one or more deteriorated regions including the deteriorated horizontal line in the display region at step S33.

Specifically, the data counting unit 510 of the deterioration compensator 500 generates accumulated data Adata of each pixel by counting the input data Idata corresponding to the pixel at step S10.

The deterioration prediction unit 520 generates stress data MSdata of each pixel based on the accumulated data Adata of the pixel, the stress data MSdata corresponding to a predictive value of the deterioration of the pixel, at step S20.

As illustrated in FIG. 8, the deteriorated region detection unit 530 of the deterioration compensator 50 detects the maximum value among the stress data MSdata of the pixels included in each of the horizontal lines, and detects a plurality of maximum stress data Max_MSdata (vertical axis of FIG. 8) corresponding to the plurality of horizontal lines (horizontal axis of FIG. 8) at step S31.

Then, as illustrated in FIG. 9, the deteriorated region detection unit 530 calculates the deterioration threshold data, based on the spread of the plurality of maximum stress data at step S32.

For example, the deterioration threshold data may be set to an average value of the plurality of maximum stress data.

Alternatively, the deteriorated threshold data may be calculated based on modes for the plurality of maximum stress data as illustrated in FIG. 9. In this case, the deteriorated region detection unit 530 detects two or more modes from the spread (FIG. 9) of the plurality of maximum stress data. That is, the deteriorated region detection unit 530 detects two or more maximum stress data which occur most frequently among the plurality of maximum stress data. The deteriorated region detection unit 530 may detect the maximum value of the two or more maximum stress data detected as the modes, select a predetermined normal distribution corresponding to the maximum stress data detected as the maximum value, detect the minimum value of the maximum stress data included in the selected normal distribution as a minimum variable, and set the detected minimum variable to the deterioration threshold data.

However, this is only an example, and the deterioration threshold data may be set to any threshold values among the plurality of maximum stress data, as long as the deteriorations of the pixels can have a recognition degree.

Then, the deteriorated region detection unit 530 detects a deteriorated horizontal line (dotted rectangle of FIG. 9) which has the maximum stress data greater than or equal to the deterioration threshold data, among the plurality of horizontal lines. The deteriorated region detection unit 530 selects one or more deteriorated regions including the deteriorated horizontal line in the display region at step S33.

At this time, the deteriorated region detection unit 530 may select a block region as a deteriorated region among a plurality of block regions formed by dividing the display region, the block region including a threshold number of deteriorated horizontal lines or more. Alternatively, the deteriorated region detection unit 530 may select a region as a deteriorated region, the region including two or more deteriorated horizontal lines within a threshold interval.

Then, the sensing control unit 540 arbitrarily selects two or more horizontal lines among horizontal lines included in each of the deteriorated regions. The sensing control unit 540 receives sensing data from the sensing data generation unit 230 of the data driver 200 of FIG. 4, the sensing data indicating the deteriorations of pixels included in the two or more horizontal lines selected in each of the deteriorated regions, at step S40.

At this time, the sensing data generation unit 230 does not generate sensing data of the whole pixels, but generates only sensing data of pixels included in two or more horizontal lines which are arbitrarily selected in each of the deteriorated regions, according to control of the sensing control unit 540. Thus, since the display panel is driven in the sensing mode for generating sensing data for a short time and a small number of horizontal lines are driven in the sensing mode, it is possible to prevent the sensing mode from being recognized.

For example, the number of horizontal lines which are selected to generate sensing data in each of the deteriorated regions may be set based on a time required for sensing one horizontal line and a threshold time during which the sensing mode is not recognized.

Next, the first and second compensation data generation units 550 and 560 generate compensation data for each pixel at step S50.

As illustrated in FIG. 10, when the corresponding pixel is a pixel included in the deteriorated region at step S51, the first compensation data generation unit 550 generates compensation data at steps S52 to S56. On the other hand, when the corresponding pixel is a pixel included in the other regions excluding the deteriorated region at step S51, the second compensation data generation unit 560 generates compensation data at step S57.

The first compensation data generation unit 550 receives the sensing data from the sensing control unit 540, the sensing data indicating the deteriorations of the pixels included in two or more horizontal lines which are arbitrarily selected among the horizontal lines included in each of the deteriorated regions, at step S52. The first compensation data generation unit 550 receives stress data of the respective pixels from the deterioration prediction unit 520 at step S53.

Then, when a difference between the sensing data and the stress data of a pixel corresponding to the sensing data is greater than or equal to a threshold difference at step S54, the first compensation data generation unit 550 corrects the stress data based on the sensing data and a predetermined sensing data weight. The first compensation data generation unit 550 calculates a correction ratio based on the corrected stress data and the original stress data, and corrects the stress data of the other pixels in the deteriorated region based on the correction ratio at step S55.

Then, the first compensation data generation unit 550 generates compensation data based on the corrected stress data at step S56.

As such, the first compensation data generation unit 550 corrects the original stress data using a weighted average between the original stress data and the sensing data based on the sending data weight. The sensing data weight may be calculated based on an accumulated driving time of the device.

That is, when the accumulated driving time (horizontal axis of FIG. 11) of the device is less than or equal to a threshold time TH_DT as illustrated in FIG. 11, the sensing data weight (weight of Sdata; vertical axis of FIG. 11) is set to 0. However, when the accumulated driving time of the device exceeds the threshold time TH_DT, the sensing data weight is set to a value that gradually increases in proportion to the threshold time TH_DT.

The threshold time TH_DT may correspond to a point of time that a characteristic difference between pixels in manufacturing the device becomes smaller than a difference in predictive value of deterioration between the pixels by the data counting method. For example, the threshold time TH_DT may be set in the range of 2,000 to 3,000.

Figure 1:
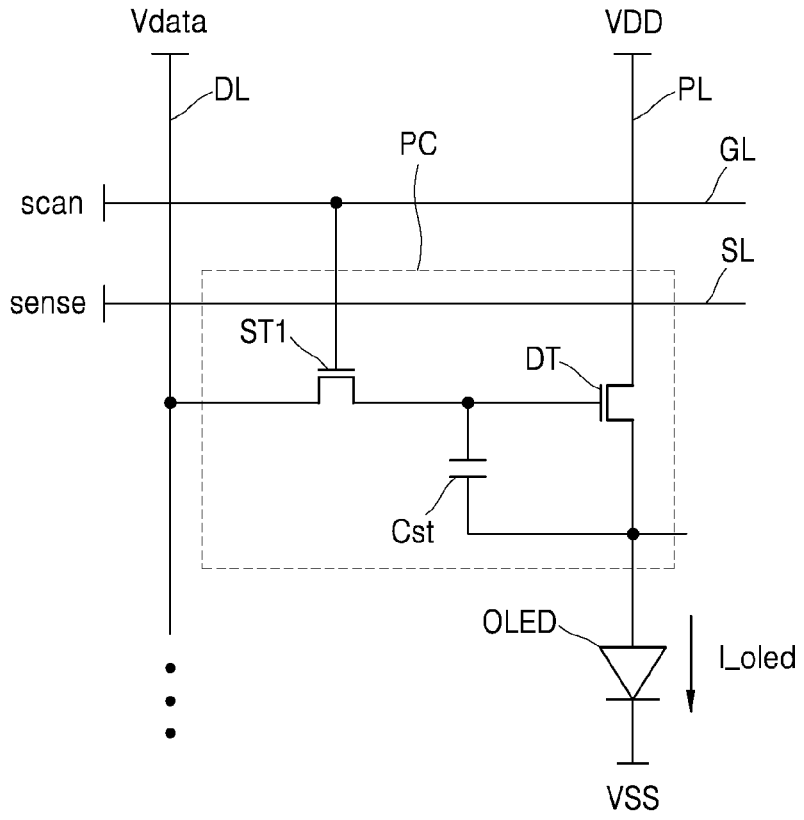
FIG. 1 is an equivalent circuit diagram corresponding to a pixel of a general OLED device.
Figure 2:
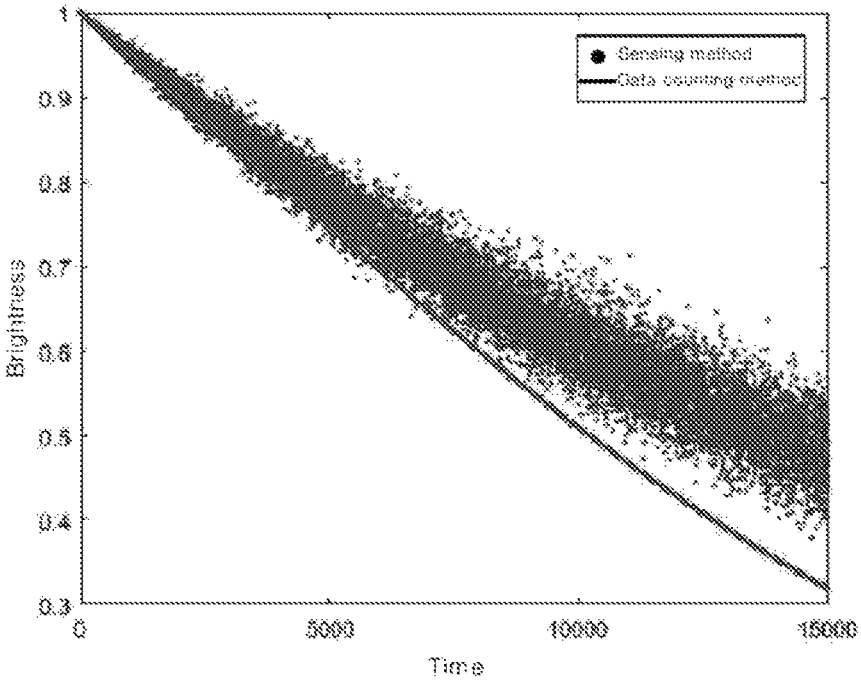
FIG. 2 is a diagram for describing a problem of a deterioration compensation method using a data counting method.

Referring to FIG. 2, the deteriorations of the pixels by the sensing method and the deteriorations of the pixels by the data counting method are equal to each other or similar to each other within an error range, immediately after the device was manufactured. After the threshold time, however, the deteriorations of at least part of the pixels by the data counting method become different from the deteriorations of the pixels by the sensing method.

Therefore, according to the embodiment of the present disclosure, a point of time that the difference between the deteriorations of the pixels by the data counting method and the deteriorations of the pixels by the sensing method can be recognized may be set to the threshold time TH_DT of FIG. 11. Furthermore, after the threshold time, stress data by the data counting method are corrected into the sensing data by the sensing method, based on the sensing data weight corresponding to the threshold time. Therefore, the stress data indicating the deteriorations of the pixels according to the data counting method may be corrected into data similar to the sensing data indicating the actual deteriorations of the pixels. Thus, since the compensation data can be generated based on the corrected stress data, the accuracy and reliability of the compensation data can be improved, which makes it possible to lower the possibility that non-compensation or overcompensation will occur.

As illustrated in FIG. 10, when a difference between the sensing data and the original stress data of the pixel corresponding to the sensing data is less than the threshold value, the first compensation data generation unit 550 generates compensation data based on the original stress data of the pixel by the deterioration prediction unit 520 at step S57.

The second compensation data generation unit 560 generates compensation data for the pixels included in the other regions except the deteriorated region, based on the stress data of the respective pixels by the deterioration prediction unit 520 at step S57.

According to the embodiments of the present disclosure, the deteriorated region is set based on the stress data of each pixel based on the data counting method. When a difference between the stress data and the sensing data in the pixels included in the deteriorated region is greater than or equal to the threshold difference, the compensation data are generated based on the corrected stress data.

On the other hand, when the corresponding pixels are included in the other regions excluding the deteriorated region or a difference between the stress data and the sensing data is less than the threshold difference even though the pixels are included in the deteriorated region, the compensation data are generated based on the stress data while the stress data are not corrected but retained.

Therefore, the deteriorations of the pixels by the data counting method may be corrected into levels similar to the actual deteriorations of the pixels by the sensing method. Thus, the reliability and accuracy of the compensation data can be improved, which makes it possible to lower the possibility that non-compensation or overcompensation will occur.

Furthermore, the stress data are corrected into the sensing data, only for the deteriorated region which is more deteriorated than the other regions, and the sensing data are generated only for two or more horizontal lines which are arbitrarily selected from the deteriorated region. Thus, a pixel driven in the sensing mode can be prevented from being recognized. Furthermore, since a period for generating the sensing data of the whole pixels does not need to be added to the driving start point or driving end time of the device, the convenience of the device can be improved.

According to the embodiments of the present disclosure, the OLED device and the method for driving the same may detect one or more deteriorated regions in the display region, based on the stress data of the plurality of pixels, which are generated by counting the input data corresponding to the respective pixels. Then, the OLED device and the method may generate compensation data of pixels included in each of the deteriorated regions, based on the stress data of the respective pixels and sensing data for deteriorations of pixels included in two or more horizontal lines which are arbitrarily selected among horizontal lines corresponding to the deteriorated region.

Specifically, when a difference between the sensing data and the original stress data of a pixel corresponding to the sensing data is greater than or equal to the threshold difference, the OLED device and the method may correct the original stress data based on the sensing data and the predetermined sensing data weight. Then, the OLED device and the method may generate compensation data based on the corrected stress data.

As such, the OLED device and the method may correct the stress data according to the sensing data indicating the actual deteriorations of the pixels included in the deteriorated region which is detected based on stress data by the data counting method, and generate compensation data based on the corrected stress data.

Therefore, the deteriorations of the pixels which are predicted according to the data counting method may be corrected according to the actual deteriorations of the pixels. Thus, the accuracy and reliability of the compensation data can be improved to thereby prevent non-compensation and overcompensation.

Furthermore, the OLED device and the method may generate sensing data only for a part of the pixels included in the deteriorated regions, such that the sensing mode for generating the sensing data can be prevented from being recognized.

While various embodiments have been described above, it will be understood to those skilled in the art that the embodiments described are by way of example only. Accordingly, the disclosure described herein should not be limited based on the described embodiments.

What is claimed is:

1. An organic light emitting display (OLED) device comprising:

a display panel including a display region corresponding to a plurality of pixels;

a gate driver supplying a scan signal and a sensing signal to the plurality of pixels;

a data driver supplying a data signal to the plurality of pixels, and sensing deteriorations of the plurality of pixels;

a timing controller driving the gate driver and the data driver in any one of a driving mode and a sensing mode; and a deterioration compensator which generates stress data for the plurality of pixels by counting input data to respective pixels over a period of time, the stress data indicative of deterioration in the respective pixels, detects one or more deteriorated regions in the display region based on the stress data of the respective pixels, receives sensing data corresponding to at least a subset of the pixels included in the one or more deteriorated regions, generates compensation data of the pixels included in the one or more deteriorated regions, based on both the sensing data and the stress data of the respective pixels, wherein the stress data is corrected when a difference between the stress data and the sensing data is greater than a predetermined threshold, and for the pixels included in regions outside of the one or more deteriorated regions, generates compensation data based on the stress data of the respective pixels without the sensing data.

2. The OLED device of claim 1, wherein the deterioration compensator comprises:

a data counter generating accumulated data of the respective pixels by counting the input data corresponding to the respective pixels;

a deterioration prediction unit generating the stress data of the respective pixels by predicting the deteriorations of the respective pixels according to the accumulated data of the respective pixels;

a deteriorated region detection unit detecting the one or more deteriorated regions in the display region, based on the stress data of the respective pixels;

a sensing control unit receiving the sensing data for the at least the subset of the pixels included in the one or more deteriorated regions; and a first compensation data generation unit generating the compensation data of the pixels included in each of the one or more deteriorated regions, based on the sensing data and the stress data of the respective pixels.

3. The OLED device of claim 2, wherein the deteriorated region detection unit detects maximum stress data of a plurality of horizontal lines each including pixels arranged in parallel to a first direction based on the stress data of the respective pixels, calculates deterioration threshold data based on the maximum stress data of the plurality of horizontal lines, detects a deteriorated horizontal line having the maximum stress data greater than or equal to the deterioration threshold data among the plurality of horizontal lines, and selects one or more deteriorated regions including the deteriorated horizontal line in the display region.

4. The OLED device of claim 2, wherein when a difference between the sensing data and an original stress data of a pixel corresponding to the sensing data is greater than or equal to a threshold difference, the first compensation data generation unit corrects the original stress data based on the sensing data and a predetermined sensing data weight.

5. The OLED device of claim 4, wherein the first compensation data generation unit calculates a correction ratio based on the original stress data and the corrected stress data, corrects stress data of the pixels included in each of the one or more deteriorated regions based on the correction ratio, and generates the compensation data of the pixels included in each of the one or more deteriorated regions based on the corrected stress data of the pixels included in the one or more deteriorated region.

6. The OLED device of claim 4, wherein the sensing data weight is calculated based on an accumulated driving time.

7. The OLED device of claim 2, wherein the deterioration compensator further comprises a second compensation data generation unit generating the compensation data of the pixels included in the regions outside of the one or more deteriorated regions in the display region, based on the stress data of the respective pixels.

8. The OLED device of claim 1, wherein the data driver supplies the data signal to the plurality of pixels, the data signal compensated through the compensation data by the deterioration compensator.

9. A method for driving an OLED device including a plurality of pixels arranged in a display region, comprising the following steps:

generating accumulated data of respective pixels by counting input data corresponding to the respective pixels over a period of time;

generating stress data of the respective pixels by predicting deteriorations of the respective pixels according to the accumulated data of the respective pixels;

detecting one or more deteriorated regions in the display region, based on the stress data of the respective pixels;

receiving sensing data corresponding to at least a subset of the pixels included in the one or more deteriorated regions;

generating compensation data of pixels included in the one or more deteriorated regions, based on both the sensing data and the stress data of the respective pixels, wherein the stress data is corrected when a difference between the stress data and the sensing data is greater than a predetermined threshold; and generating compensation data of pixels included in regions outside of the one or more deteriorated regions based on the stress data of the respective pixels without the sensing data.

10. The method of claim 9, wherein the detecting of the one or more deteriorated regions comprises the following steps:

detecting maximum stress data corresponding to each of a plurality of horizontal lines each of which includes pixels arranged in parallel to a first direction, based on the stress data of the respective pixels;

calculating deterioration threshold data based on maximum stress data of the plurality of horizontal lines; and detecting a deteriorated horizontal line having the maximum stress data greater than or equal to the deterioration threshold data among the plurality of horizontal lines, and selecting the one or more deteriorated regions including the deteriorated horizontal line in the display region.

11. The method of claim 9, wherein the generating of the compensation data of each of the pixels included in each of the one or more deteriorated regions comprises the following steps:

correcting original stress data, based on the sensing data and a predetermined sensing data weight, when a difference between the sensing data and the original stress data is greater than or equal to a threshold difference;

calculating a correction ratio based on the original stress data and the corrected stress data;

correcting stress data of each of the pixels included in each of the one or more deteriorated regions, based on the correction ratio; and generating the compensation data of each of the pixels included in each of the one or more deteriorated regions, based on the corrected stress data of each of the pixels included in each of the one or more deteriorated regions.

12. The method of claim 11, wherein the sensing data weight is calculated in proportion to an accumulated driving time, when the accumulated driving time is greater than or equal to a threshold time.

13. The method of claim 11, wherein generating the compensation data of each of the pixels included in each of the one or more deteriorated regions comprises a step of generating the compensation data of each of the pixels included in each of the one or more deteriorated regions based on the original stress data of the respective pixels, when the difference between the sensing data and the original stress data is less than the threshold difference.

* * * * *